US011108202B2

(12) United States Patent
Houry

(10) Patent No.: US 11,108,202 B2
(45) Date of Patent: Aug. 31, 2021

(54) RELAY SOCKET AND RELAY ASSEMBLY COMPRISING A RELAY SOCKET

(71) Applicant: Connecteurs Electriques Deutsch, Evreux (FR)

(72) Inventor: Laurent Houry, Mesnils sur Iton (FR)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 16/447,217

(22) Filed: Jun. 20, 2019

(65) Prior Publication Data

US 2020/0014162 A1 Jan. 9, 2020

(30) Foreign Application Priority Data

Jul. 4, 2018 (EP) ..... 18305873

(51) Int. Cl.
*H01R 33/76* (2006.01)
*H01R 13/518* (2006.01)
*H01R 33/97* (2006.01)

(52) U.S. Cl.
CPC ..... *H01R 33/7664* (2013.01); *H01R 13/518* (2013.01); *H01R 33/765* (2013.01); *H01R 33/7657* (2013.01); *H01R 33/7671* (2013.01); *H01R 33/97* (2013.01)

(58) Field of Classification Search
CPC ..... H01R 33/7657; H01R 33/7664; H01R 33/765; H01R 13/518
USPC ..... 439/366
See application file for complete search history.

(56) References Cited

U.S. PATENT DOCUMENTS 3,680,016 A * 7/1972 Becker ..... H01H 50/045 335/106
3,731,259 A 5/1973 Occhipinti
5,383,800 A * 1/1995 Saka ..... B60R 16/02 439/76.2
5,766,035 A * 6/1998 Alibert ..... H01H 50/048 439/362
6,257,925 B1 * 7/2001 Jones ..... H01R 13/6273 439/357

(Continued)

FOREIGN PATENT DOCUMENTS

EP 3176804 A1 * 6/2017 ..... H01R 13/621
EP 3176804 A1 6/2017

(Continued)

OTHER PUBLICATIONS

Extended European Search Report, European Patent Application No. 18305873.4, dated Jan. 17, 2019, 5 pages.

(Continued)

*Primary Examiner* — Peter G Leigh
(74) *Attorney, Agent, or Firm* — Barley Snyder

(57) ABSTRACT

A relay socket providing an interface between a relay and a mounting structure comprises an upper section configured for mounting the relay, a lower section configured for mounting to the mounting structure, a plurality of mounting holes opening to an upper surface of the upper section and configured to receive a plurality of fastening elements of the relay, and a plurality of sleeve inserts configured to be fastened within the mounting holes, Each of the sleeve inserts surrounds a fixation member adapted to connect to the fastening elements.

22 Claims, 6 Drawing Sheets

(56) References Cited

U.S. PATENT DOCUMENTS

| | | | | |
|---|---|---|---|---|
| 6,273,750 | B1 * | 8/2001 | Malkowski, Jr. .... | H01R 9/2491<br>439/499 |
| 6,511,345 | B1 * | 1/2003 | Hwang ..... | H01R 12/707<br>439/541.5 |
| 6,767,246 | B2 * | 7/2004 | Quinn ..... | H01R 9/2491<br>439/555 |
| 9,960,538 | B2 * | 5/2018 | Nagasaki ..... | H01R 13/639 |
| 2002/0142643 | A1 * | 10/2002 | Quinn ..... | H01R 9/2491<br>439/553 |
| 2018/0287311 | A1 * | 10/2018 | Houry ..... | H01H 50/048 |

FOREIGN PATENT DOCUMENTS

| | | | | |
|---|---|---|---|---|
| JP | H0896910 | A | 4/1996 | |
| WO | WO-2017093315 | A1 * | 6/2017 ..... | H01R 13/261 |

OTHER PUBLICATIONS

Abstract of JPH0896910 A, dated Apr. 12, 1996, 1 page.
Amphenol Air LB, "Sockets for Relays," Electric and Electronic Connection Systems, Edition 10 / 00.

* cited by examiner

RELAY SOCKET AND RELAY ASSEMBLY COMPRISING A RELAY SOCKET

CROSS-REFERENCE TO RELATED APPLICATION

This application claims the benefit of the filing date under 35 U.S.C. § 119(a)-(d) of European Patent Application No. 18305873.4, filed on Jul. 4, 2018.

FIELD OF THE INVENTION

The present invention relates to a relay socket and, more particularly, to a relay socket providing an interface between a relay and a mounting structure.

BACKGROUND

Relay sockets suitable for being installed on a mounting structure, such as a panel, are used extensively for facilitating the electrical connection of a large number of electrical relays side by side in a dense arrangement. In the field, it is sometimes difficult to determine where a specific relay should be mounted. If a relay is mounted on a wrong socket, the relay or the circuit which is served by the relay may malfunction.

SUMMARY

A relay socket providing an interface between a relay and a mounting structure comprises an upper section configured for mounting the relay, a lower section configured for mounting to the mounting structure, a plurality of mounting holes opening to an upper surface of the upper section and configured to receive a plurality of fastening elements of the relay, and a plurality of sleeve inserts configured to be fastened within the mounting holes, Each of the sleeve inserts surrounds a fixation member adapted to connect to the fastening elements.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
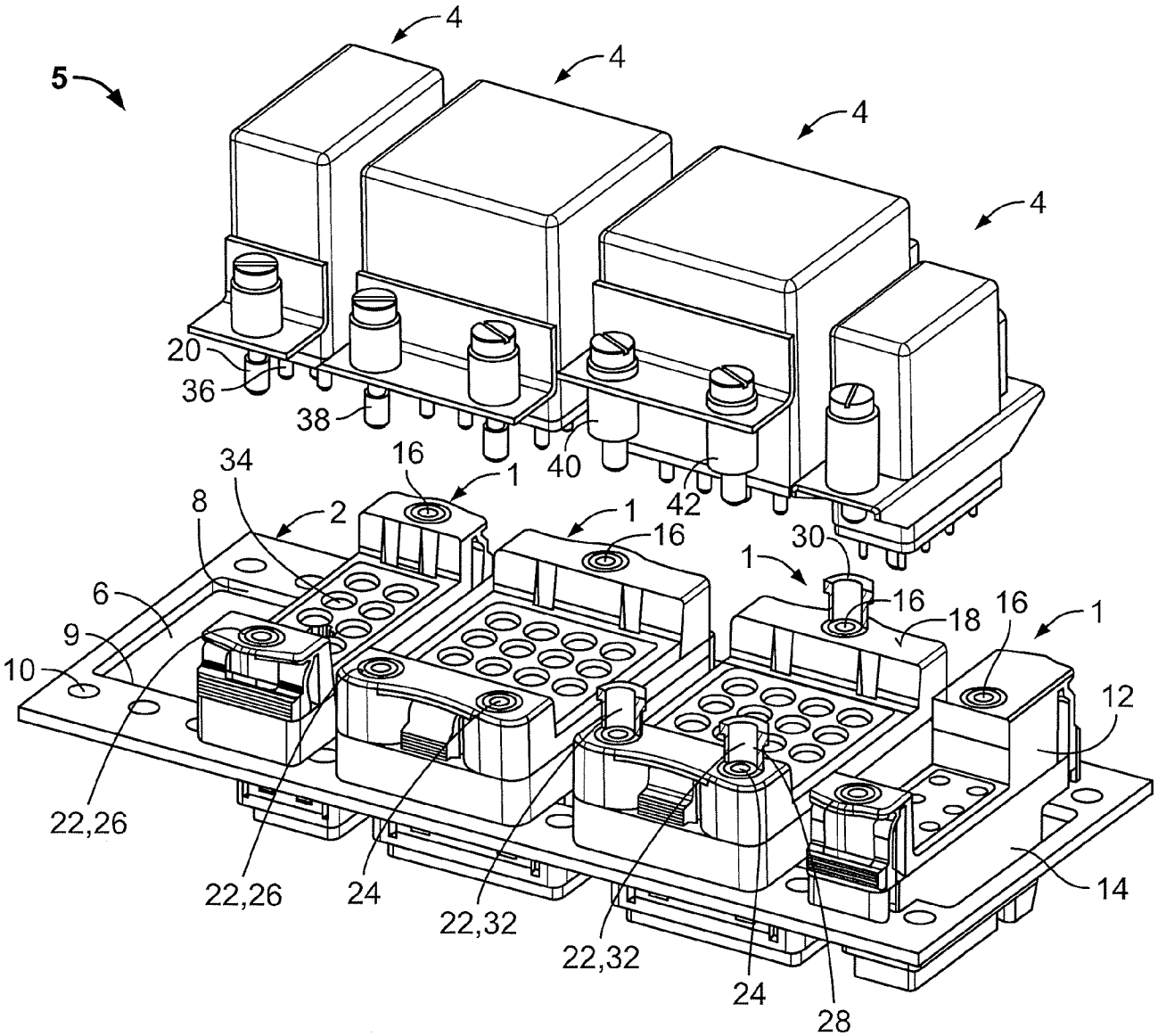
FIG. 1 is a perspective view of a plurality of different relay assemblies according to an embodiment mounted on a mounting structure.

Embodiments of the present invention will be described hereinafter in detail with reference to the attached drawings.

In the figures, the same reference numerals are used for elements which correspond to one another in terms of their function and/or structure. Elements shown in the drawings can be omitted if the technical effects of these elements are not needed for a particular application, and vice versa; elements that are not shown or described with reference to the figures but can be added if the technical effect of those particular elements is advantageous in a specific application. The present invention may, however, be embodied in many different forms and should not be construed as being limited to the embodiments set forth herein; rather, these embodiments are provided so that the disclosure will convey the concept of the invention to those skilled in the art.

A plurality of different relay sockets 1 are shown in FIG. 1 mounted on a mounting structure 2 with a respective plurality of relays 4 adapted to be mounted on the relay sockets 1. A relay assembly 5 according to an embodiment comprises the relay socket 1 and the corresponding relay 4.

As shown in FIG. 1, the mounting structure 2, a panel in an embodiment, is provided with an aperture 6 into which the relay socket 1 is partially inserted and to which the relay socket 1 is fixed at one or more of the aperture edges, as described in greater detail below.

In the embodiment shown in FIG. 1, the mounting structure 2 comprises a rectangular aperture 6 that substantially fits a lower side of the relay socket 1 and to which the relay socket 1 is fixed at two opposite fixation edges 8, 9. In other embodiments, the relay sockets 1 shown in FIG. 1 can be mounted on different types of mounting structures 2 as long as two fixation edges are provided, between which the relay sockets 1 can be inserted, e.g. between two parallel plates of an installation panel arranged at a sufficient distance from each other for receiving and mounting the sockets 1. The mounting structure 2 is therefore not limited to a panel cut-out and may have other shapes than the one illustrated.

Figure 2:
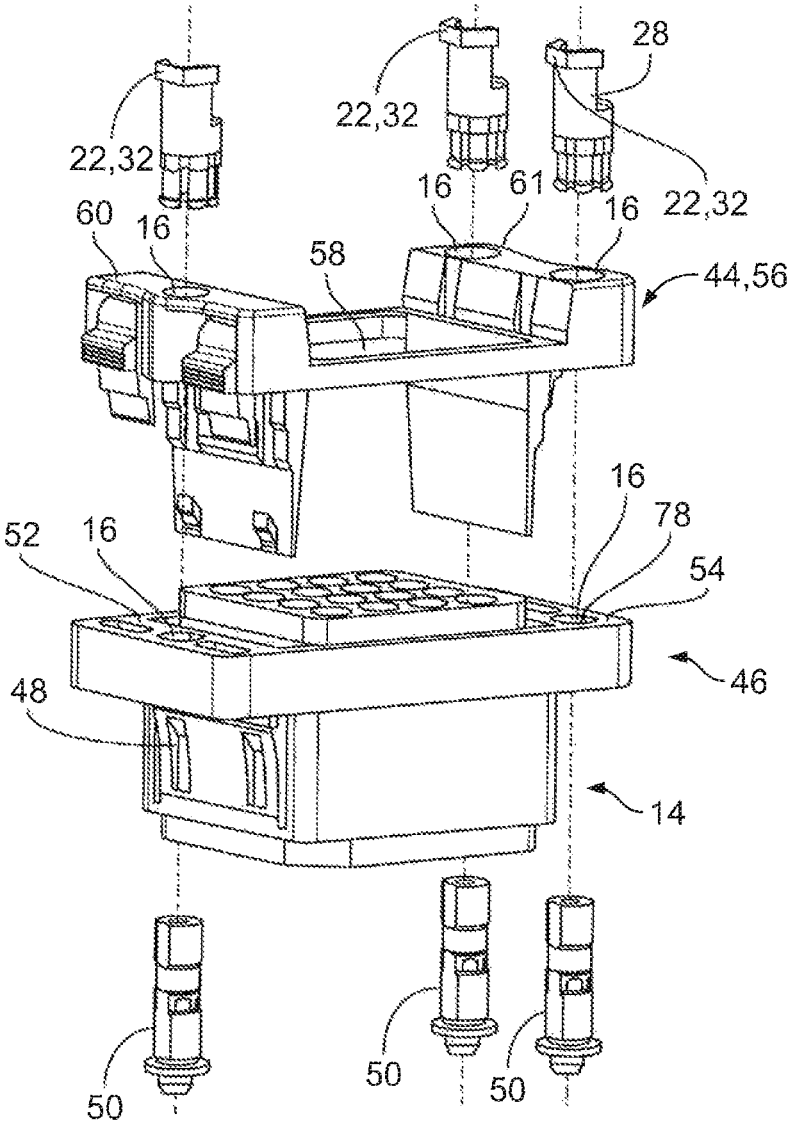
FIG. 2 is an exploded perspective view of a relay socket according to an embodiment.

The mounting structure 2, as shown in FIG. 2, comprises two rows of positioning holes 10, which are equidistantly arranged on each lateral side of the aperture 6 so that the relay sockets 1 can be mounted in a defined position. Further, relay sockets 1 with different types of mounting mechanisms are also possible, such as fastening elements; in this case, the positioning holes 10 would function as fixation holes through which the fastening elements such as screws can be mounted. The relay socket 1 is not limited to the mounting mechanism shown in the different figures.

As shown in FIG. 1, the relay socket 1 comprises an upper section 12, configured for mounting the respective relay 4, and a lower section 14, configured for mounting the relay socket 1 to the mounting structure 2. The relay sockets 1 further comprise at least one mounting hole 16 opening to an upper surface 18 adapted for receiving fastening elements 20 of the respective relay 4.

To fool-proof the relay sockets 1 and ensure that the correct relay 4 is mounted on the corresponding socket 1, the relay socket 1 can be coded. In order to code the relay socket 1, a set of interchangeable sleeve inserts 22 is fastened within the mounting holes 16. In an embodiment, the number of interchangeable sleeve inserts 22 is larger than the number of mounting holes 16.

In FIG. 1, two types of the sleeve insert 22 are shown, which differ in length and shape. The first type is a cylindrical sleeve insert 22, which does not extend beyond the upper surface 18 of the relay socket 1. The sleeve insert 22 does not prevent the fastening element 20 from engaging a fixation member 24 that is surrounded by the sleeve insert 22, and will thus be referred to as an uncoded sleeve insert 26. The other type of sleeve insert 22 protrudes from the upper surface 18, with the protruding part 28 being semicircular in shape and ending with an external hexagonal end 30. Due to the protruding part 28, a fixation member that does not have a complementary shape cannot engage the fixation member 24 of the relay socket 1. Consequently, the relay 4 is not compatible with said relay socket 1 and cannot be mounted on the relay socket 1. Thus, sleeve inserts 22 with a protruding part 28 will be referred to as coded sleeve inserts 32. However, a relay socket 1 can also be coded using uncoded and/or coded sleeve inserts 26, 32.

As shown in FIG. 1, the upper section 12 has a number of connection openings 34 arranged in the central area for receiving contact pins 36 provided on a lower side of the relay 4. The connection openings 34 are electrically coupled to corresponding openings on the opposite side of the relay socket 1 via connecting elements, which are provided inside the relay socket 1. Wires can be inserted into the corresponding openings 34 so that the relay socket 1 functions as an interface between a relay 4 and the electric wires.

The relay 4, as shown in FIG. 1, comprises the contact pins 36 on a lower side for engaging the connection openings 34 of the relay socket 1 and subsequently mounting the relay 4. In order to securely fix the connection between the relay 4 and the relay socket 1, the relay 4 comprises the fastening elements 20, which are arranged coaxially with the corresponding mounting holes 16 and can be fixed to the fixation member 24 of the relay socket 1. The relay 4 can be coded in order to ensure that the relay 4 is not accidentally mounted onto the wrong relay socket 1. For this purpose, the relay 4 can be provided with uncoded and/or coded fixation members 38, 40, where the coded fixation member 40 comprises a semicircular sheathing 42. The semicircular sheathing 42 can be arranged at different rotational positions and contacts the protruding part 28 of the sleeve insert 32 if the protruding part 28 is not arranged in the complementary rotational position. As a result, the fastening element 20 and the contact pins 36 cannot engage the fixation member 24 and the connection openings 34, respectively. It is possible to have a universal relay socket 1 which can be connected to the relay 4 using coded and/or uncoded fastening elements 20.

As shown in FIG. 2, the positioning and alignment of the relay socket 1 on the mounting structure 2 can be facilitated by providing one or more guiding pins 50, which can be positioned in the respective positioning holes 10 of the mounting structure 2. The structure and function of the guiding pin 50 will be explained in greater detail below with reference to FIG. 3.

The relay socket 1, as shown in FIG. 2, has an upper part 44 and a separate lower part 46. The lower part 46 comprises the lower section 14. In order to fix the lower part 46 to the mounting structure 2, the lower part 46 has an integrated clipping system 48 for locking the relay socket 1 to the fixation edges 8, 9, without the need for any tightening elements or tools, when the relay socket 1 is in place. The upper part 44 serves as an actuation member 56 and is mechanically coupled to the clipping system 48 of the lower part 46 such that the locking state of the clipping system 48 can be set or changed by operating the upper part 44.

Figure 7:
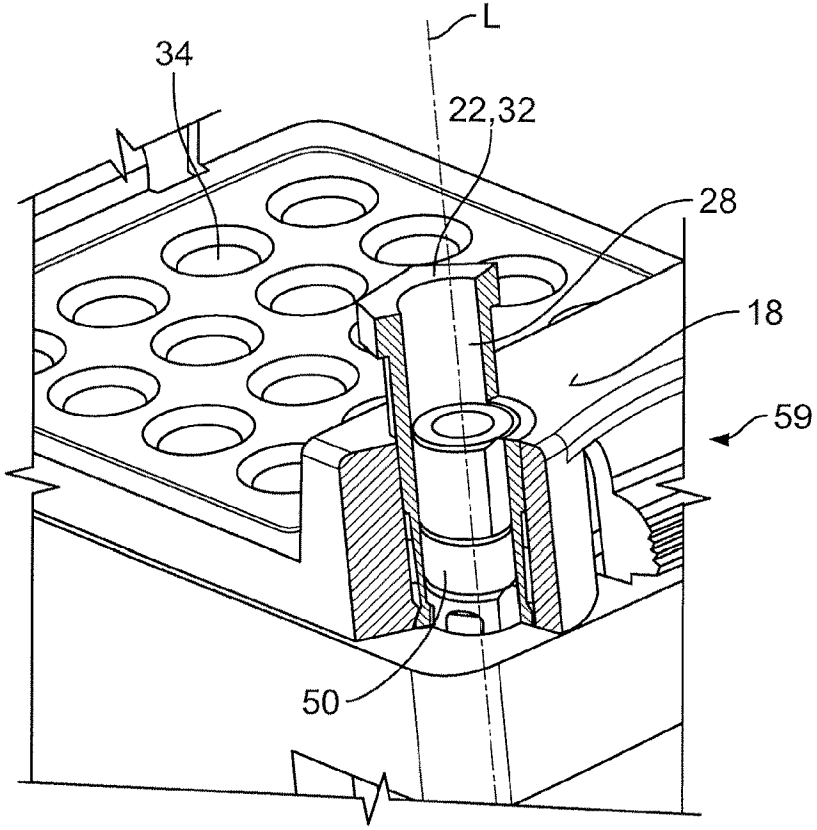
FIG. 7 is a perspective view of the relay socket with the movable upper part in a first position.
Figure 6:
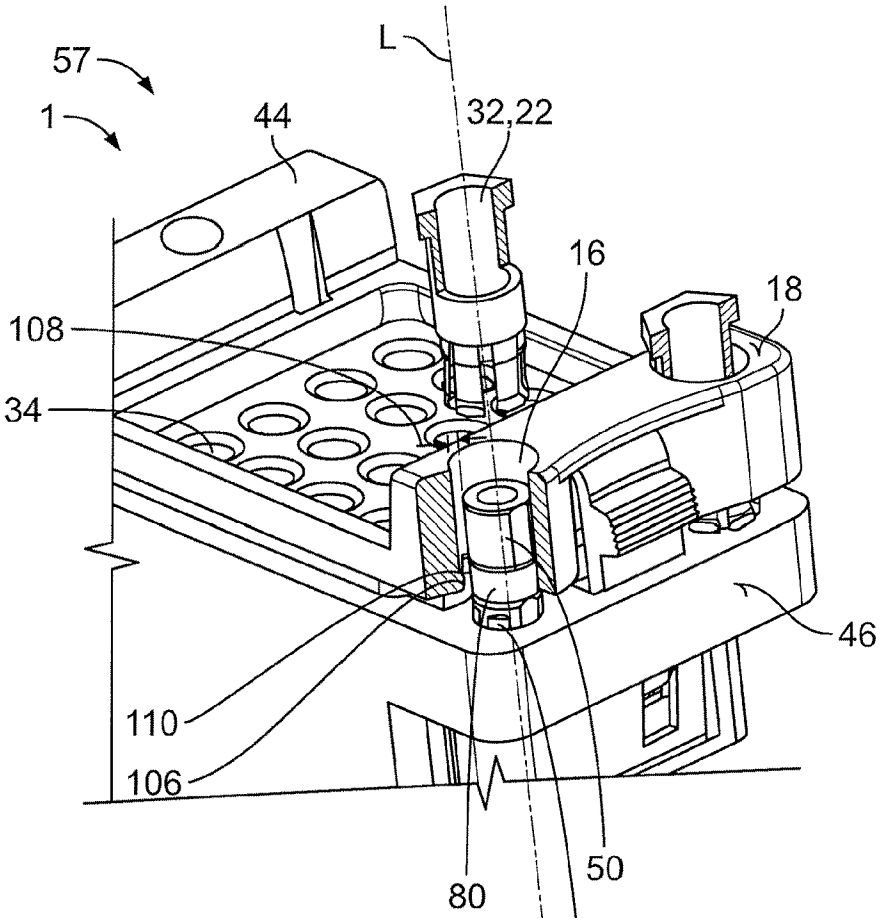
FIG. 6 is a perspective view of the relay socket with a movable upper part in a second position.
Figure 8:
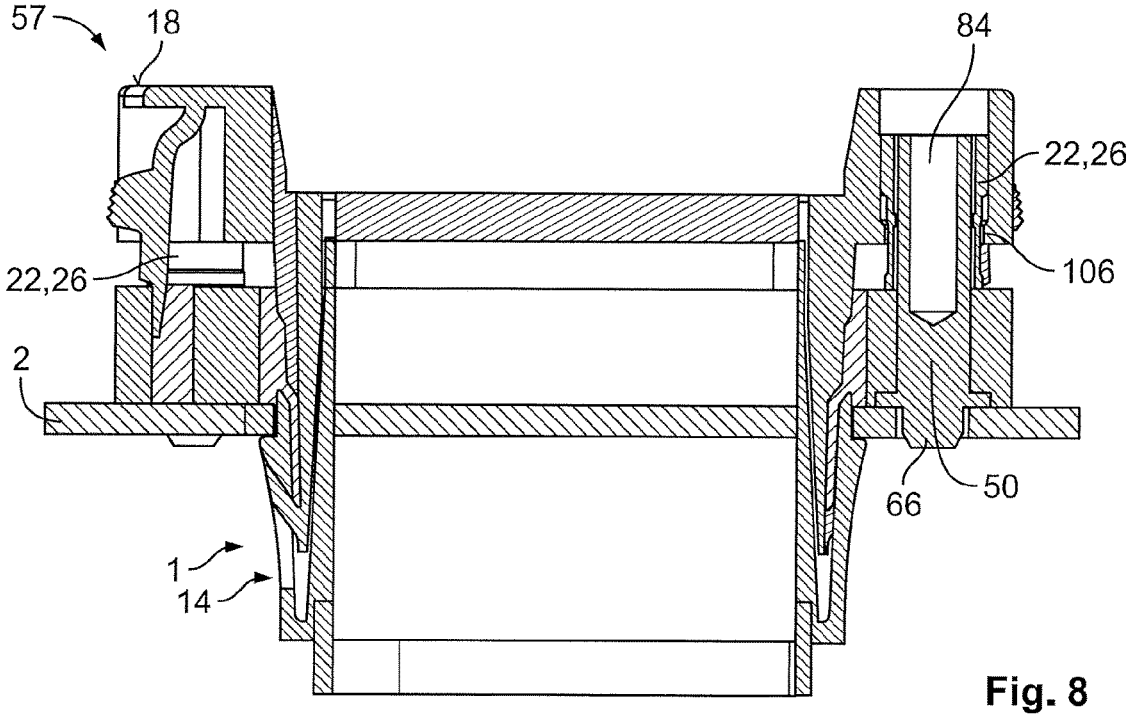
FIG. 8 is a sectional side view of the relay socket with the movable upper part in the second position.
Figure 9:
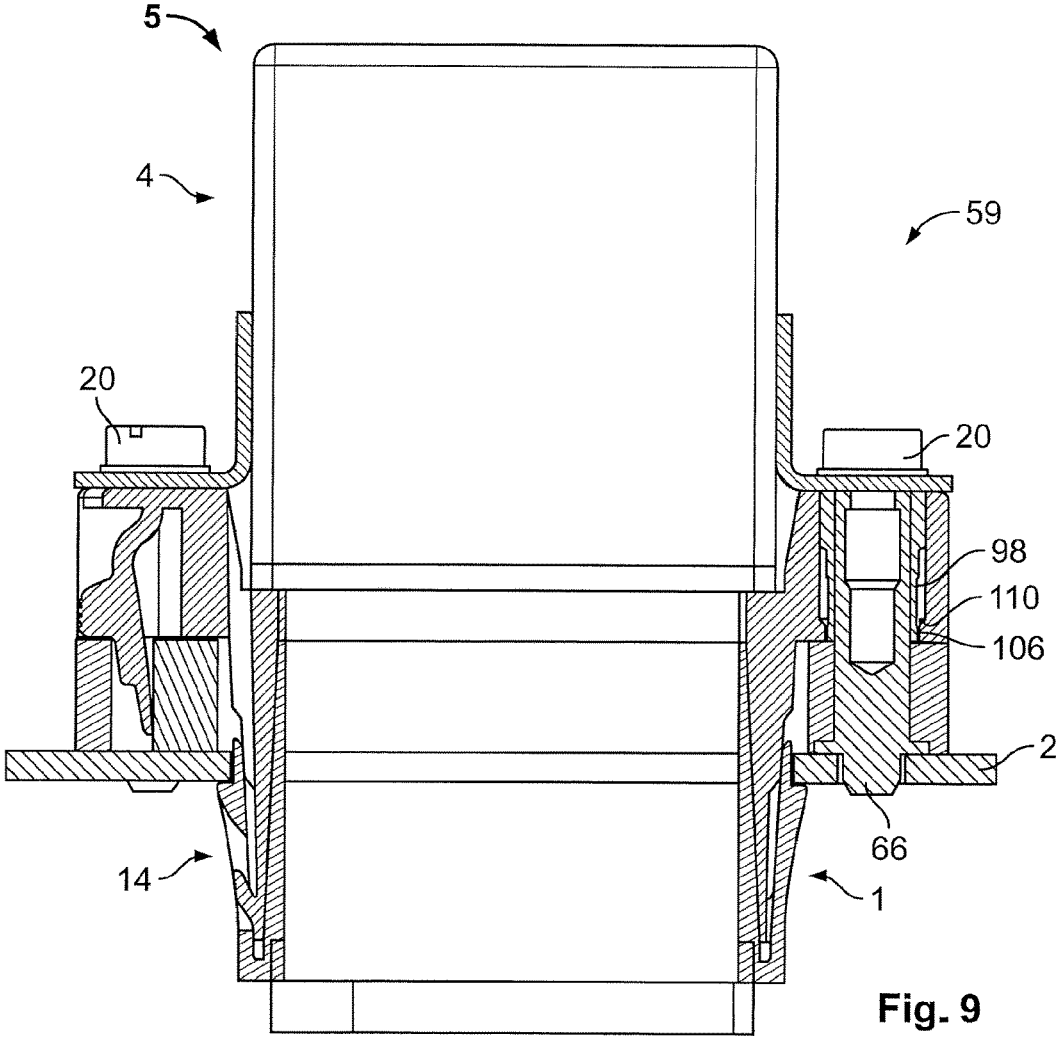
FIG. 9 is a sectional side view of an assembled relay assembly according to an embodiment.

The upper part 44 can be moved downwards with respect to the lower part 46 to a first position in which the upper part 44 rests on top of the lower part 46 and in which movement of the sleeve insert 22 with respect to the upper part 44 and/or lower part 46 as well as movement of the lower part 46 with respect to the mounting structure 2 is prevented. The upper part 44 can be moved further upwards with respect to the lower part 46 to a second position in which the upper part 44 is at least partially spaced apart from the lower part 46, allowing relative movement of the sleeve insert 22 with respect to the upper and/or lower part 44, 46. The relay socket 1 with the upper part 44 in the second position 57 is shown in FIGS. 6 and 8, while a relay socket 2 with the upper part 44 in the first position 59 is shown in FIGS. 1, 7 and 9. In an embodiment, the upper part 44 and lower part 46 are made of molded electrically insulating materials, such as plastic.

Both the upper part 44 and the lower part 46 feature mounting holes 16, which are arranged on ledges 52 and 54 as shown in FIG. 2, which extend outwards from the lower section 14 so as to rest on the mounting structure 2 while the lower section 14 is at least partly inserted into the aperture 6. The mounting holes 16 are formed as through holes, so that the guiding pin 50 can be inserted into the lower part 46 protruding towards the upper part 44. In order to ensure a compact relay assembly, the guiding pin 50 does not extend beyond the upper surface 18 of the relay socket 2.

The upper part 44 may be designed so that the relay 4 can only be plugged into the relay socket 1 when the upper part 44 is in the first position. The upper part 44 may be stirrup shaped, having a central, flat base with a window 58 shown in FIG. 2 for providing access to the connection openings 34, and two lateral supports 60, 61 at the left and right sides of the flat base for arranging fixation plates of the relay 4. The height of the lateral supports 60, 61 is such that the contact pins 36 can only be fully inserted into the connection openings 34 when the upper part 44 is in the first position. The stirrup shape thus prevents the relay 4 from being plugged into the relay socket when the upper part 44 is not in the first position.

As seen in FIG. 2, a sleeve insert 22 can be inserted into the mounting hole 16. The sleeve insert 22 will be positioned between the guiding pin 50 and an inner surface of the mounting hole 16. The sleeve insert 22 is used for coding the relay socket 1 so as to configure the relay socket 1 according to a complementary coded relay 4. For coding the relay socket 1, coded sleeve inserts 32, as shown in FIG. 2, or uncoded sleeve inserts 26 can be used. The function and structure of the sleeve insert 22 are described in greater detail below with reference to FIGS. 4 and 5.

Figure 3:
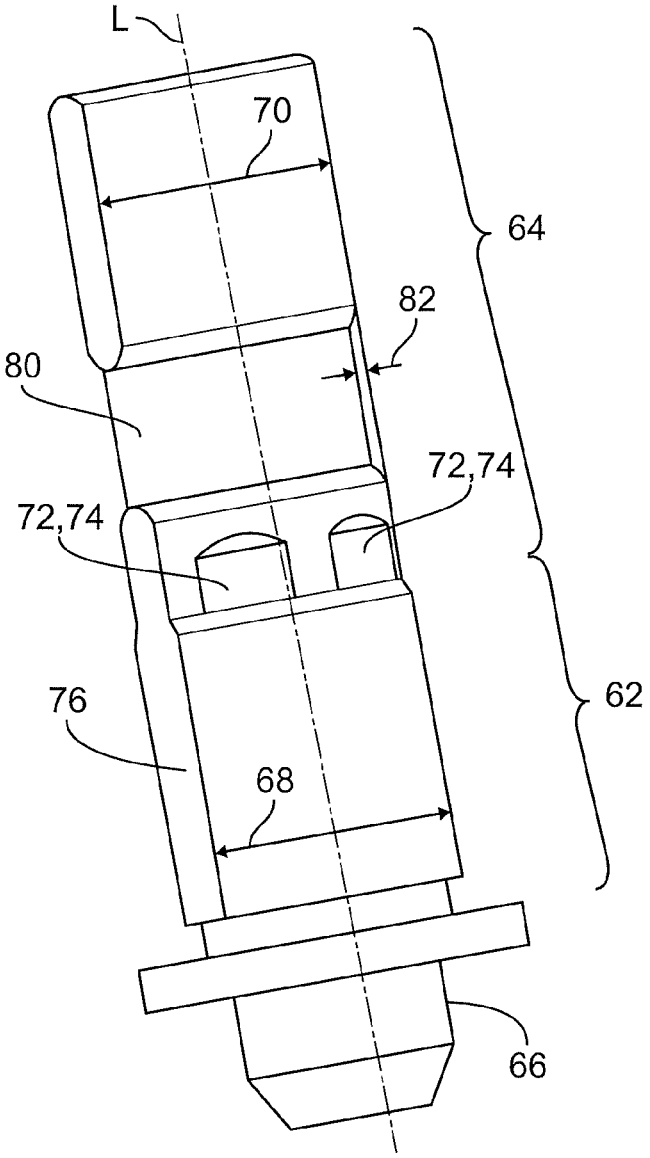
FIG. 3 is a perspective view of a guiding pin of the relay socket.

The guiding pin 50, as shown in FIG. 3, comprises an essentially cylindrical body with a bottom and a top section 62, 64. The guiding pin 50 serves to move the upper part 44 up and down relative to the lower part 46 and is therefore fixed within the mounting hole 16 of the lower part 46 but not the upper part 44. An end part of the guiding pin 50 may partially protrude from the lower side of the ledges 52, 54, so as to serve as positioning pins 66, which can engage the positioning holes 10 of the mounting structure 2. The main function of the guiding pin 50 is to fix the fastening elements 20 of the relay 4 and serve as a stop for the relay 4.

As shown in FIG. 3, the bottom section 62 has a clear width 68, which is longer than the clear width 70 of the top section 64, so as to being fittingly inserted into the mounting hole 16 in the lower part 46. Due to the smaller clear width 70 at the top section 64, a gap between the inner surface of the mounting hole 16 at the upper part 44 and the guiding pin is created for inserting the sleeve insert 22.

The bottom section 62 is essentially as long as the mounting hole 16 in the lower part 46. The top section 64 comprises an indexing structure 72 shown in FIG. 3, which is formed by circumferentially dispersed flat surfaces that are arranged at a 60° angle to one another. The guiding pin 50 therefore comprises an essentially hexagonal cross-section perpendicular to a longitudinal axis L. This hexagonal indexing structure 72 ensures that the sleeve insert 22 can be positioned in six different rotational positions, thus allowing six different coding configurations of a respective coded sleeve insert 32, each of which is arranged at a 60° angle from its neighboring coding configuration. However, the indexing structure 72 is not limited to a hexagonal structure: if more or fewer configurations placed at different angles to one another are desired, any other polygonal structure is possible. The indexing structure 72 may be arranged bordering the bottom section 62.

The flat surfaces of the indexing structure 72 are formed by recesses 74, shown in FIG. 3, from which circular segments have been removed. The recesses 74 are part of a locking mechanism adapted for form-fittingly receiving a latch of the sleeve insert 22, which is described in greater detail below. In order to ensure the correct rotational position of the guiding pin 50, the guiding pin 50 is provided with two guiding surfaces 76 arranged opposite one another and extending along the longitudinal axis L from the beginning of the bottom section 62 to the end of the top section 64 opposite the bottom section 62. The guiding surfaces 76 are flat and also provide a flat surface of the indexing structure 72. Thus, the guiding surfaces 76 are also arranged at a 60° angle to the neighboring flat surfaces.

The mounting hole 16 of the lower part 46 comprises a shape that is complementary to the shape of the guiding pin 50. The mounting hole 16 of the lower part 46 consequently features two flat surfaces 78, shown in FIG. 2, positioned opposite one another. The guiding surfaces 76 ensure that the guiding pin 50 is inserted into the mounting hole 16 in the correct rotational position. A rotationally symmetrical guiding pin 50 would cause difficulties in configuring the correct coding position of the sleeve insert 22 with respect to the coded fastening member 40 of the respective relay 4.

The guiding pin 50 further comprises a notch 80 shown in FIG. 3, in particular a circumferential notch 80, on the top section 64 between the indexing structure 72 and the end of the guiding pin opposite the bottom section 62. The notch 80 provides a flexion gap 82, which allows the sleeve insert 22 to be at least partially flexed towards the guiding pin 50.

The guiding pin 50 further comprises a blind hole 84, as shown in FIG. 8, arranged coaxially within the guiding pin 50 and open to the end of the guiding pin 50 opposite the bottom section 62. The blind hole 84 serves as the fixation member 24 for receiving the fastening elements 20, such as screws, of the relay 4. Each blind hole 84 may have a threaded region for tightening the screws. The threaded region may be provided at a predetermined depth, such that the screw can only be screwed when the upper part 44 is in the first position. Moreover, the fixation of the relay 4 by tightening the screws in the relay socket 1 simultaneously secures the upper part 44 to the lower part 46 in the first position, so that the relay socket 1 and/or the sleeve insert 22 cannot be accidentally demounted without first removing the relay 4.

In an embodiment, the guiding pin 50 is made from a material which has a good wear resistance to the relative movement between parts and is suitable for tightening a screw, such as a metal.

Figure 5:
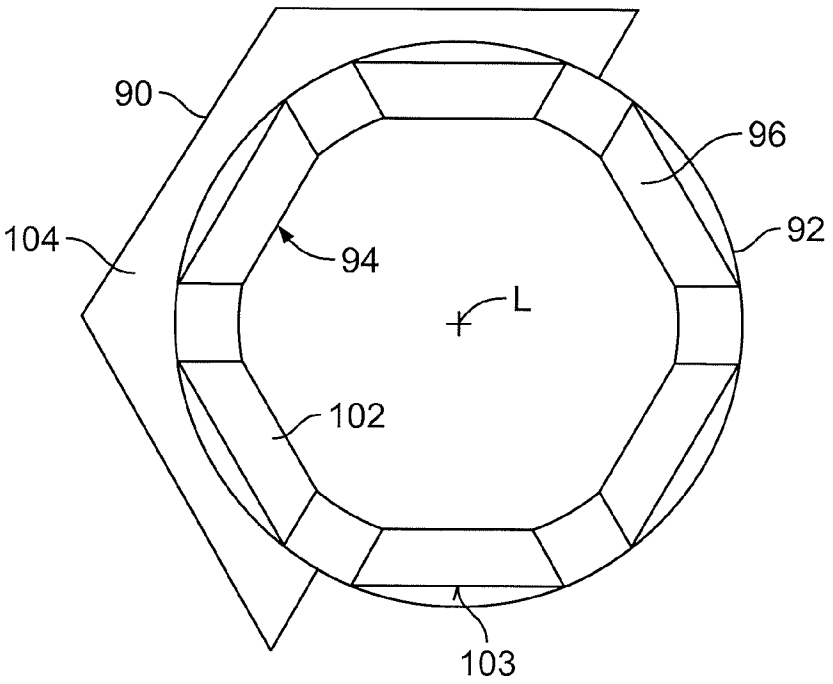
FIG. 5 is a plan view of the coded sleeve insert.
Figure 4:
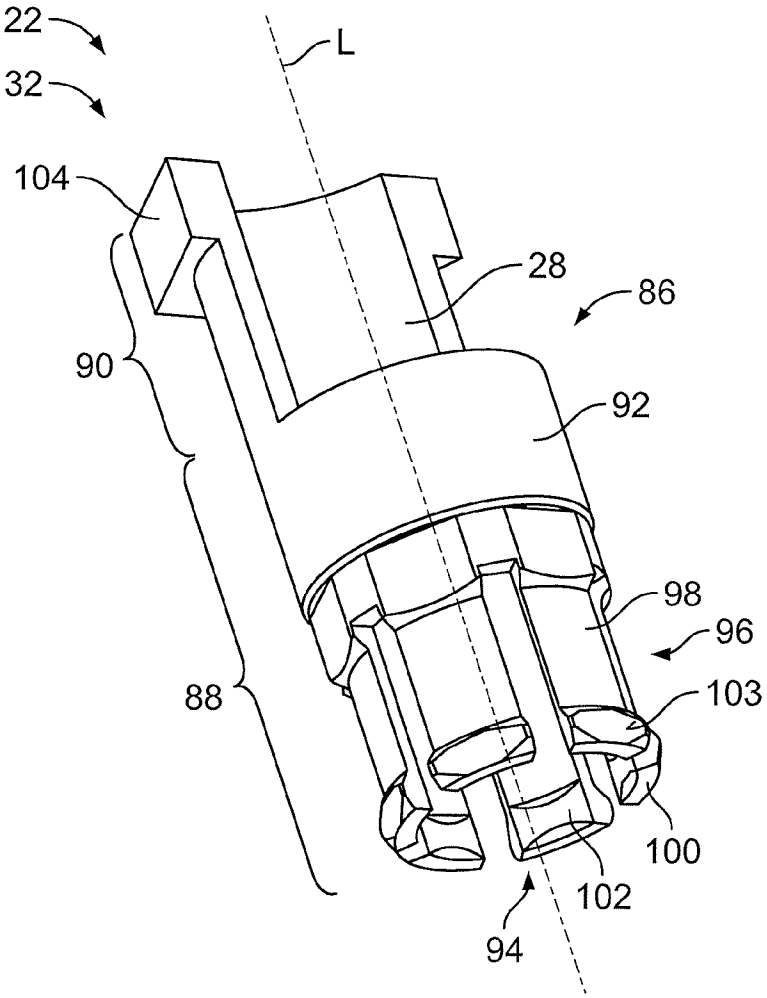
FIG. 4 is a perspective view of a coded sleeve insert of the relay socket.

As shown in FIG. 4, the sleeve insert 22 comprises a longitudinal hollow-shaped body 86 extending along a longitudinal axis L. The coded sleeve insert 32 has a holding structure 88 provided at the bottom and a coding structure 90 provided at the top. The holding structure 88 comprises a cylindrical section 92 with a material thickness to form-fittingly fit in the mounting hole 16 between the guiding pin 50 and the mounting hole 16. The cylindrical section 92 borders the coding structure 90. The holding structure 88 further comprises an indexing structure 94 which matches the indexing structure 72 of the guiding pin 50. Thus, the coded sleeve inserts 32 form a polygonal, in this case hexagonal, cross-section in a plane perpendicular to the longitudinal axis L, as shown in FIG. 5. The flaps 96 have a smaller outer diameter than the cylindrical section 92, so that a radially inwards-protruding locking protrusion of the mounting hole 16 can be moved relative to the flap 96 without being subjected to friction, as described in greater detail below.

In an embodiment, the coding structure 90 may not be rotationally symmetrical, so that the complementary coded fastening element 20 can complete the rotational symmetry when the relay 4 is mounted onto the relay socket 1. A sleeve insert 32 with a rotational non-symmetrical coding structure 90 can be fastened in different rotational positions so as to further increase the number of coding possibilities. In an embodiment, the sleeve insert 32 has, at least sectionwise, a cross-section in a plane perpendicular to a longitudinal axis of the sleeve insert 32 that is not infinitely rotationally symmetrical. Hence, the different rotational positions can be determined with high precision.

The indexing structure 94 is formed by flaps 96 extending along the longitudinal axis L, which are radially distanced from one another as shown in FIGS. 4 and 5. The flaps 96 are arranged at a 60° angle from one another, so that a total of six flaps 96 exist. However, different arrangements according to the indexing structure 94 are possible. For example, if twelve different rotational positions are desired, the flaps could be arranged at a 30° angle from one another, so that a total of twelve flaps exist, creating a dodecagonal cross-section in a plane perpendicular to the longitudinal axis L. The flaps 96 are separated from one another to further increase the flexibility of the flaps 96. Each flap 96 comprises a deformation zone 98 with decreased material thickness compared to the immediate surroundings, increasing elastic flexibility and thereby allowing the flaps 96 to be flexed in a radially inward and/or outward direction. Due to the deformation zone 98, the point at which the flaps 96 are flexed is predefined.

As shown in FIG. 4, the indexing structure 94 is formed on the inside of a foot 100 of each flap 96 by an inwards-protruding latch 102 with a flat surface complementary to the recess 74 formed on the guiding pins 50. The latches 102 can form-fittingly be received in the recesses 74 defining the rotational position of the coded insert sleeve 32. When rotating the coded insert sleeve 32, the flaps 96 are flexed until the latches 102 can engage the next recess 74 when the coded sleeve insert 32 has been rotated by the predetermined angle, in this exemplary case 60°.

The foot 100 of each flap 96, as shown in FIGS. 4 and 5, further comprises a flattened pressing surface 103 on the radially outwards side of the foot 100. The pressing surface 103, in an embodiment, is complementary to an inward-protruding locking protrusion of the mounting structure 16, so as to form a form-fitting engagement between the pressing surface 103 and the locking protrusion. Each flap 96 is locked between the recess 74 formed on the guiding pins 50 and the locking protrusion. In order to secure the rotational position of the sleeve insert 32, the number and arrangement of the locking protrusions, recesses 74, and flaps 96 are identical.

The indexing structure 94 comprises a length that is essentially the same as the length of the mounting hole 16 in the upper part 44. The coding structure 90 protrudes from the upper surface 18 and has an arc-shaped cross-section in a plane perpendicular to the longitudinal axis L. In this embodiment, the protruding part 28 has a semicircular cross-section in the plane perpendicular to the longitudinal axis L. However, any other arc-shaped cross-section is possible as long as the sheathing of the coded fastening element 20 has a complementary shape.

The coding structure 90 comprises a base 104, as shown in FIGS. 4 and 5, which protrudes essentially perpendicular to the longitudinal axis L in a radially outwards direction from the coding structure 90, and which has an essentially hexagonal shape. However, any other shape of the base 104 is possible, as long as it is adapted to a complementary base of the fastening element's sheathing 42 and/or relay 4. A bottom face of the sheathing 42 abuts a top face of the guiding pin 50, which serves as a stop for the relay 4 and, in an embodiment, consists of a material offering good wear resistance.

The functional interaction between the coded sleeve insert 32, the upper part 44, and the guiding pin 50 will now be explained in greater detail with reference to FIGS. 6 and 7.

In FIG. 6, the relay socket 1 is shown with the upper part 44 in the second position and at least partially spaced apart from the lower part 46. A corner of the upper part 44 has been cut away in order to provide a view of the interior of the mounting hole 16. The mounting hole 16 comprises radially inwards-protruding locking protrusions 106, wherein each locking protrusion 106 is arranged at a 60° angle from its neighbouring locking protrusion 106, and wherein each locking protrusion and respective recess 74 of the guiding pin 50 are positioned opposite one another. The guiding pin 50 is form-fittingly fixed inside the mounting hole 16 of the lower part 46, so that the upper part 44 can be moved relative to the guiding pin 50. The locking protrusions 106 are arranged circumferentially at the lower end of the mounting hole 16 at the upper part 44 facing towards the lower part 46, so that the locking protrusions 106 are aligned in a plane perpendicular to the longitudinal axis L when the upper part 44 is in a first position and abuts the lower part 46 as shown in FIG. 7.

In the second position shown in FIG. 6, the locking protrusions 106 are aligned with the notch 80, increasing a gap 108 between the guiding pin 50 and the mounting hole 16. The gap 108 is further increased by the flexion gap 82, which is shown in FIG. 3. The flexion gap 82 provides room for the holding structure 88 to be flexed towards the guiding pin 50 when the sleeve insert 22 is inserted into the mounting structure. To aid flexion of the holding structure 88 when inserting the sleeve insert 22, the locking protrusions 106 are provided with chamfers 110 on the side facing away from the lower part 46.

After the sleeve insert 22 is inserted into the mounting hole 16, the sleeve insert 22 abuts the lower part 46, and the matching indexing structures 72, 94 are coupled. Each of the latches 102 is received in a corresponding recess 74. The locking protrusions 106 are aligned with the deformation zone 98, so that they do not contact the sleeve insert 22 and in order to allow free rotation of the sleeve insert 22. The cylindrical section 92 is form-fittingly inserted in the gap 108 between the guiding pin 50 and the mounting hole 16. Since the sleeve insert 22 is freely rotatable in the second position, it is not necessary to dismount the relay socket 1 in order to reconfigure the insert sleeves 22. Furthermore, if only a different rotational position is desired, the sleeve insert 22 does not need to be removed from the relay socket 1. If a different coding is desired, whereby a coded sleeve insert 32 is exchanged for an uncoded sleeve insert 26 or vice versa, the sleeve insert 22 can simply be pulled out of the mounting hole 16, with or without the aid of tools, such as pliers, without needing to dismount the relay socket 1 from the mounting structure 2. Thus, easy and rapid coding or recoding of the relay socket 1 is achieved.

Once all of the sleeve inserts 22 have been inserted into the corresponding mounting holes 16 and rotated to their desired rotational positions, the upper part 44 can be moved to the first position, shown in FIG. 7, in which the upper part 44 abuts the lower part 46 and the locking protrusions 106 are pressed against the respective pressing surfaces 103, further pressing the latches 102 against the recesses 74. Due to the locking protrusions 106 pressing against the pressing surfaces 103, flexion of the flaps 96 is prevented. The flaps 96 are clamped between the recess 4 and the locking protrusion. Thus, the sleeve insert 22 is fixed inside the mounting hole 16 and cannot be moved relative to the relay socket 1. Movement of the sleeve insert 22 is prevented by friction and/or form fit.

The relay socket 1 is shown in FIG. 8 the upper part 44 in the first position 59. Uncoded sleeve inserts 26 are inserted into the mounting holes 16. In contrast to the coded sleeve insert 32, the uncoded sleeve insert 26 has a rotationally symmetrical cylindrical shape and does not have a coding structure. The uncoded sleeve insert 26 does not protrude from the upper surface 18. A holding structure 88 of the uncoded sleeve insert 26 does not comprise separate flaps with an indexing structure since the rotational position of the uncoded sleeve insert 26 is irrelevant. Rather, the uncoded sleeve insert 26 comprises a circumferential deformation zone 98 with increased flexibility and a lower material thickness than the immediate surroundings. Thus, the foot of the coded sleeve insert 26 has an increased material thickness compared to the deformation zone 98.

As with the coded sleeve insert 32, the foot of the uncoded sleeve insert 26 will be deflected towards the guiding pin 50 from the locking protrusion 106 when inserting the uncoded sleeve insert 26 into the mounting hole 16 in the second position. Rotational positioning is not necessary. Hence, the uncoded sleeve insert 26 does not need to be provided with an indexing structure or latches. However, in order to fix the uncoded sleeve insert 26 by form fit, latches can be provided in an embodiment.

A relay assembly 5 with a relay socket 1 and a relay 4 mounted on the relay socket 1 is shown in FIG. 9. The locking protrusion 106 presses against the foot 100 of the sleeve insert 22, which in turn is pressed against the guiding pin 50. Thus, the sleeve insert 22 is frictionally fixed inside the mounting hole 16.

As shown in FIG. 9, the relay 4 is mounted on top of the upper part 44, wherein the fastening element 20 of the relay 4 is fixed in the blind hole of the guiding pin 50. As uncoded sleeve inserts 26 are fastened inside the mounting holes 16, the respective fastening elements 20 are also uncoded. The guiding pin 50 serves as a stop for the relay 4 and for fixing the fastening element 20. In an embodiment, the guiding pin 50 is made from a material with good wear resistance. In an embodiment, the fixture from the relay 4 to the relay socket 1 is solely provided by the guiding pins 50, so that the sleeve insert 22 can be produced using a lightweight, flexible, and electrically insulating material such as plastic.

A universal relay socket 1 is provided, wherein the relay socket 1 can easily be coded by fastening interchangeable coded and/or uncoded sleeve inserts 26, 32 into the mounting holes 16. There is no need to have specific relay sockets 1 for different purposes. Furthermore, recoding can easily be achieved without the need to dismount the relay socket 1 from the mounting structure 2.

When the relay socket 1 and relay assembly 5 are used, it is possible to have one socket design for differently coded relays 4. By coding the relay socket 1, it can be configured differently to the surrounding relay sockets 1. In addition, the user can reduce their stock of different coded or uncoded relay sockets 1 by replacing them with a single type of relay socket 1 that is compliant with multiple different configurations. Furthermore, the user is afforded greater freedom when coding the relay socket 1 because the relay sockets 1 can be coded with coded or uncoded sleeve inserts 26, 32.

The fastening system of the sleeve inserts 22 within the mounting holes 16 can be independent from the mounting mechanism for mounting the relay socket 1 to the mounting structure 2 and therefore not be affected by the mounting of the relay socket 1 to the mounting structure 2. The relay socket 1 can thus be pre-coded before mounting the relay socket 1 to the mounting structure 2 and/or can be easily reconfigured without the need to dismount the relay socket 1 from the structure 2.

What is claimed is:

1. A relay socket providing an interface between a relay and a mounting structure, comprising:

an upper section configured for mounting the relay;

a lower section configured for mounting to the mounting structure;

a plurality of mounting holes opening to an upper surface of the upper section and configured to receive a plurality of fastening elements of the relay;

a plurality of sleeve inserts configured to be fastened within the mounting holes, each of the sleeve inserts surrounds a fixation member adapted to connect to the fastening elements; and a guiding pin protruding within one of the mounting holes toward the upper surface.

2. The relay socket of claim 1, wherein the sleeve inserts include a plurality of interchangeable sleeve inserts each configured to be fastened within the mounting holes.

3. The relay socket of claim 2, wherein the interchangeable sleeve inserts differ in at least one of a length and a shape.

4. The relay socket of claim 1, wherein the sleeve inserts include at least one sleeve insert that does not protrude from the upper surface.

5. The relay socket of claim 1, wherein the sleeve inserts include at least one sleeve insert that protrudes from the upper surface.

6. The relay socket of claim 1, wherein the sleeve inserts include at least one sleeve insert that extends along a longitudinal axis and has a polygonal cross-section in a plane perpendicular to the longitudinal axis.

7. The relay socket of claim 6, wherein the sleeve inserts include at least one sleeve insert that has an arc-shaped cross-section in a plane perpendicular to the longitudinal axis.

8. The relay socket of claim 1, wherein one of the sleeve inserts is positioned in an at least partly circumferential gap between the guiding pin and the one of the mounting holes.

9. The relay socket of claim 8, wherein the one of the mounting holes and/or the guiding pin has an indexing structure and the one of the sleeve inserts has a matching indexing structure.

10. The relay socket of claim 9, wherein the indexing structure and the matching indexing structure are configured to allow only discrete relative rotational positions between the one of the sleeve inserts and at least one of the mounting hole and the guiding pin.

11. The relay socket of claim 10, wherein the guiding pin form-fittingly engages with the one of the mounting holes.

12. The relay socket of claim 10, wherein the one of the sleeve inserts form-fittingly engages with the one of the mounting holes.

13. The relay socket of claim 8, wherein the guiding pin has a notch increasing the at least partly circumferential gap between the guiding pin and the one of the mounting holes.

14. The relay socket of claim 1, further comprising an upper part and a lower part separate from the upper part, the lower part has the lower section and the upper part has the upper section and the mounting holes.

15. The relay socket of claim 14, wherein the upper part has a first position in which the upper part abuts the lower part and movement of the sleeve inserts in the mounting holes is blocked.

16. The relay socket of claim 15, wherein the upper part has a second position in which the upper part is at least partially spaced apart from the lower part and the sleeve inserts are movable relative to the lower part.

17. A relay assembly, comprising:

a relay having a plurality of fastening elements; and a relay socket including an upper section configured for mounting the relay, a lower section configured for mounting to a mounting structure, a plurality of mounting holes opening to an upper surface of the upper section and configured to receive the fastening elements of the relay, a plurality of sleeve inserts configured to be fastened within the mounting holes, each of the sleeve inserts surrounds a fixation member adapted to connect to the fastening elements and mount the relay to the relay socket, and a guiding pin protruding within one of the mounting holes toward the upper surface.

18. The relay assembly of claim 17, wherein the fastening elements and the sleeve inserts are complementary to one another.

19. A relay socket providing an interface between a relay and a mounting structure, comprising:

an upper section configured for mounting the relay;

a lower section configured for mounting to the mounting structure;

a plurality of mounting holes opening to an upper surface of the upper section and configured to receive a plurality of fastening elements of the relay; and a plurality of sleeve inserts configured to be fastened within the mounting holes, each of the sleeve inserts surrounds a fixation member adapted to connect to the fastening elements, the sleeve inserts include a plurality of interchangeable sleeve inserts each configured to be fastened within the mounting holes, the interchangeable sleeve inserts differ in at least one of a length and a shape.

20. A relay socket providing an interface between a relay and a mounting structure, comprising:

an upper section configured for mounting the relay;

a lower section configured for mounting to the mounting structure;

a plurality of mounting holes opening to an upper surface of the upper section and configured to receive a plurality of fastening elements of the relay; and a plurality of sleeve inserts configured to be fastened within the mounting holes, each of the sleeve inserts surrounds a fixation member adapted to connect to the fastening elements, the sleeve inserts include at least one sleeve insert that protrudes from the upper surface.

21. A relay socket providing an interface between a relay and a mounting structure, comprising:

an upper section configured for mounting the relay;

a lower section configured for mounting to the mounting structure;

a plurality of mounting holes opening to an upper surface of the upper section and configured to receive a plurality of fastening elements of the relay; and a plurality of sleeve inserts configured to be fastened within the mounting holes, each of the sleeve inserts surrounds a fixation member adapted to connect to the fastening elements, the sleeve inserts include at least one sleeve insert that extends along a longitudinal axis and has a polygonal cross-section in a plane perpendicular to the longitudinal axis.

22. The relay socket of claim 21, wherein the sleeve inserts include at least one sleeve insert that has an arc-shaped cross-section in a plane perpendicular to the longitudinal axis.

* * * * *